US005188012A

United States Patent [19]

Emich

[11] Patent Number: 5,188,012

[45] Date of Patent: Feb. 23, 1993

[54] SUBSTRATE MACHINING DEVICE HAVING IMPROVED BLADE CONTACT

[75] Inventor: Georg Emich, Rossdorf, Fed. Rep. of Germany

[73] Assignee: Maschinenfabrik Goebel GmbH, Darmstadt, Fed. Rep. of Germany

[21] Appl. No.: 693,802

[22] Filed: Apr. 30, 1991

[30] Foreign Application Priority Data

May 4, 1990 [DE] Fed. Rep. of Germany ..... 4014238

[51] Int. Cl.[5] ..... B26D 1/24

[52] U.S. Cl. ..... 83/496; 83/501

[58] Field of Search ..... 83/496, 500, 501, 502, 83/503-508, 673-676, 698

[56] References Cited

U.S. PATENT DOCUMENTS

| | | | |
|---|---|---|---|
| 3,055,249 | 9/1962 | Lord | 83/501 |
| 3,080,784 | 3/1963 | Schneider | 83/502 X |
| 3,459,086 | 8/1969 | Reeder, Jr. | 83/496 X |
| 3,682,032 | 8/1972 | Pfeiffer | 83/496 |
| 4,195,542 | 4/1980 | Zimmer | 83/676 X |
| 4,274,319 | 6/1981 | Frye et al. | 83/496 X |
| 4,614,142 | 9/1986 | Fritz et al. | 83/496 |

FOREIGN PATENT DOCUMENTS

| | | |
|---|---|---|
| 310796 | 6/1919 | Fed. Rep. of Germany . |
| 697108 | 10/1940 | Fed. Rep. of Germany . |
| 1841256 | 11/1961 | Fed. Rep. of Germany . |

*Primary Examiner*—Frank T. Yost
*Assistant Examiner*—Eugenia A. Jones
*Attorney, Agent, or Firm*—Watson, Cole, Grindle & Watson

[57] ABSTRACT

A device for machining sheet like material comprises first and second substantially circular machining tools having peripheral machining edges. The tools are each mounted on a shaft for rotation about the shaft axis. At least one of the tools is provided with magnetic means used to force the two tools into continuous contact with each other at a machining nip during operation of the device.

7 Claims, 2 Drawing Sheets

SUBSTRATE MACHINING DEVICE HAVING IMPROVED BLADE CONTACT

BACKGROUND OF THE INVENTION

The present invention relates to a device for pressing a substrate cutting tool, in particular a mostly circular knife, against another device interacting with the tool. The device is used to machine substrates made of continuous webs or sheets of paper, film, fabric, metals, plastics or the like.

Devices of the aforementioned kind are usually used to cut, perforate or likewise machine relatively wide webs in their longitudinal direction, for example, into significantly narrower strips. After the machining operation, the resulting strips travel to another processing machine. The cutting tool that is used interacts with a matching counter-tool. One example is a cutting tool designed as an upper knife which has a substantially circular outer contour and a corresponding bottom knife. However, it is also possible that the substrate to be machined, for example a web of paper, loops around a rotatable, revolving cylinder, where at least one upper knife presses the substrate against the cylinder so as to machine the substrate. During the respective machining operation, it is necessary that the tools used in the machining operation interact well with one another so that a desired result of the machining operation with desired quality can be obtained.

During what is known as a scissor cut, which is obtained with rotary knives, for example, with an upper and a bottom rotary knife, interaction of the knives is crucial. If the interacting knives do not interact well with one another during the cutting operation unclean cut edges results. This result can lead to difficulties in the subsequent winding up operation of the cut strips. Other difficulties arise when cutting such substrates at higher travel velocities of the substrates, i.e. as the speed of the usually rotatable cutting tool increases. Often the causes for this are irregularities in the quality of the material of the participating tools. Furthermore, it is desirable to have one cutting tool with which a wide range of materials can be machined, for example, thin and thick webs of paper or thin and thick webs of plastic film.

A cutter with upper and bottom knives is known from U.S. Pat. No. 3,055,249, wherein, for example, the upper knife is arched so that it is elastic and thus can be pressed against the respective bottom knife. With this device the force with which the respective upper knife presses against the respective bottom knife can be set only relatively coarsely, i.e., with the aid of the elasticity of the upper knife. It is not possible to adjust the force to the substrate to be cut.

A device is known from German Patent 310 796 in which the upper knife is pressed against the bottom knife with the aid of a spring. Thus, it is possible through the use of selectively different springs to press the upper knife with varying strength against the bottom knife. The drawback here is that the respective spring rubs against the upper knife and the frictional forces are subject, as well known, to a stick-slip effect, i.e., the transfer of frictional forces that cannot be precisely defined. Thus, it is difficult to transfer the pressure forces to the appropriate active point. This applies especially when the rotary knife is rotated at a very high speed about its geometric axis, such high speed results in very rapidly changing forces at the cutting point, for example, cutting forces and bending of the rotary knife. Thus, constantly changing frictional forces of the spring results, especially when the substrates are machined at a fast travel speed. The same applies to devices as known from German utility model 18 41 256, in which the knives ar pressed against the appropriate counterknife by loop springs.

Another device is known from German Patent 697 108, in which the knife is positioned on an auxiliary hub, where the auxiliary hub can be pivoted with respect to a main hub by spring forces. This device also has relatively large interacting tools rendering it difficult to machine a substrate evenly at today's high travel speeds which subject the device to knife bending and expansion when passing the cutting point. Thus, poor cutting quality results.

SUMMARY OF THE INVENTION

To avoid the aforementioned problems, a contacting device for a substrate machining tool is provided according to the invention in which, even at high travel speeds of the substrate to be machined, the force of a tool against a counter tool can be adjusted. According to the invention the contacting pressure between the two tools is subject to a minimum of interference factors when operating the device. A satisfactory cut or machining results even at current high travel speeds of the substrate.

According to the present invention magnetic means are used for the machining tools to make contact with each other. For example, magnets are inserted into the supporting attachment of the knife. The supporting attachment can be a hub, for example, made of nonmagnetic material. In addition, a disk, a cover or the like made of magnetic material can be attached coaxially to the hub. With the present invention it is possible to take into account the frequent load changes at the machining point in such a manner that the machining tool or at least the tool part that vibrates during machining, is as light-weight as possible. In addition, interference factors are eliminated when the forces necessary for the machining operation are generated, as can occur by inaccurately controlled frictional forces. In addition, the nonhomogeneity of the materials from which the cutting tools are finished and the imperfect nature of the processing operation are also obviated. Other features and advantages follow from the following description of the invention.

The present invention is explained in detail with the aid of the embodiment discussed below not restricting the inventive thought shown schematically in the accompanying Figures. In the present respect non-essential details that are sufficiently known to the expert are not shown in the Figures for the sake of greater clarity. Therefore, only those parts that are necessary to explain the device in detail are shown in the Figures. The invention is not limited to the exemplary embodiment but should be recognized as contemplating all modifications within the skill of an ordinary artisan.

DETAILED DESCRIPTION OF THE INVENTION

While the present invention relates generally to a machining device, the following description relates to an embodiment encompassing a cutting device in accordance with the invention.

Figure 1:
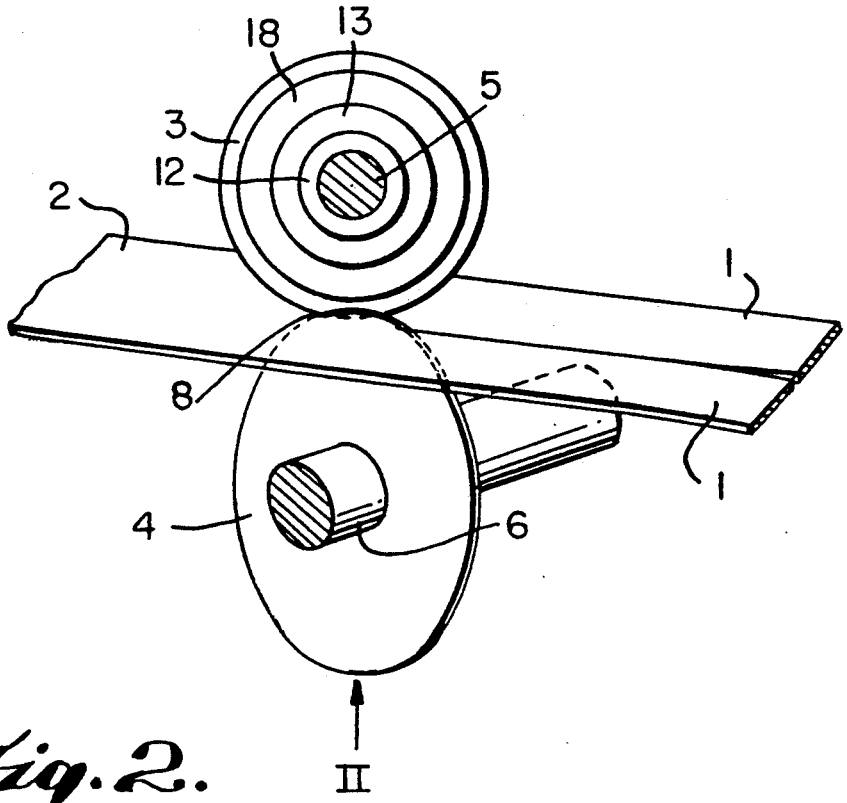
FIG. 1 is a schematic side elevational view of the machining device incorporating the present invention, taken substantially along line I—I of FIG. 3, the bottom knife not being illustrated for the sake of clarity.
Figure 2:
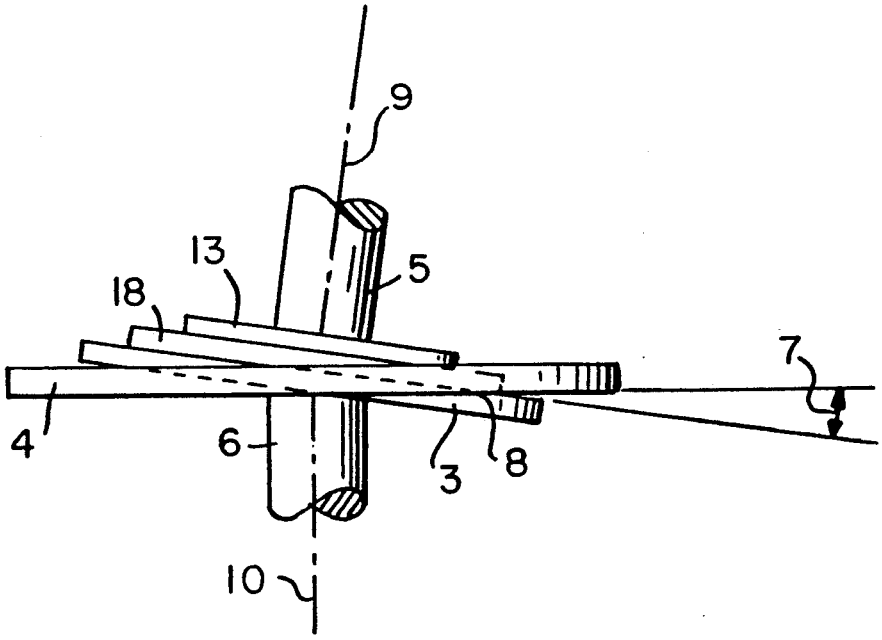
FIG. 2 is a schematic bottom view of the device, taken along arrow II of FIG. 1.

As shown in FIGS. 1 and 2, a web 2 made of paper, film, fabric, plastic, metal, or the like to be divided into strips 1, travels through a cutter which comprises at least one pair of knives such as an upper knife 3 and a bottom knife 4. Each knife has a peripheral cutting edge. Several such pairs of knives can be arranged in succession in the viewing direction of FIG. 1. Upper knife 3 is mounted on a shaft 5 for rotation about the shaft axis 9 and the bottom knife 4 is mounted on a shaft 6 for rotation about the shaft axis 10. This can be accomplished by either of shafts 5 and 6 extending over the entire width of web 2 and being rotatable in a machine frame (not illustrated). However, it is also possible that the knives, frequently only the upper knife, can be rotated in a separate holder. This holder is attached to the frame of the machine.

Upper knife 3 and bottom knife 4 are sloped relative to one another so that in the bottom view according to FIG. 2 an angle 7 is formed between the upper and the bottom knife so that a point 8 is produced where the upper and bottom knife make contact with one another. Point 8 is the cutting point which actually does not represent a point in the mathematical sense, since the knives 3 and 4 are flattened off by the forces acting on the knives. The knives and their axes of rotation are arranged such that at rest the two knives are substantially in contact with each other at point 8. In this manner a scissor-like cut is produced that results in a small cutting area due to the forces and the elasticity of the knives as in the case of scissors.

Figure 3:
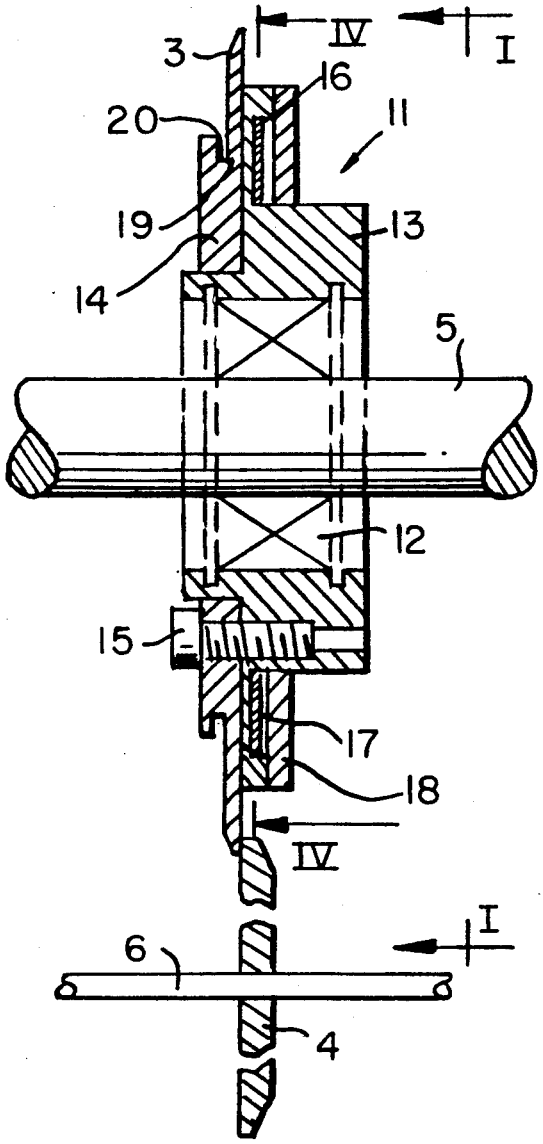
FIG. 3 is a cross sectional view of the upper knife and supporting attachment of FIG. 1 according to the present invention.

The respective knife 3 can be rotated on shaft 5 with the insertion of a hub 11 and a bearing 12 as shown in FIG. 3. This arrangement is primarily used when knife 3 is not to be supported by a holder mounted on the machine. If there is a separate holder, shaft 5 can also be stationary and mounted on the holder. If, however, shaft 5 can be rotated, bearing 12 is not necessary.

Figure 4:
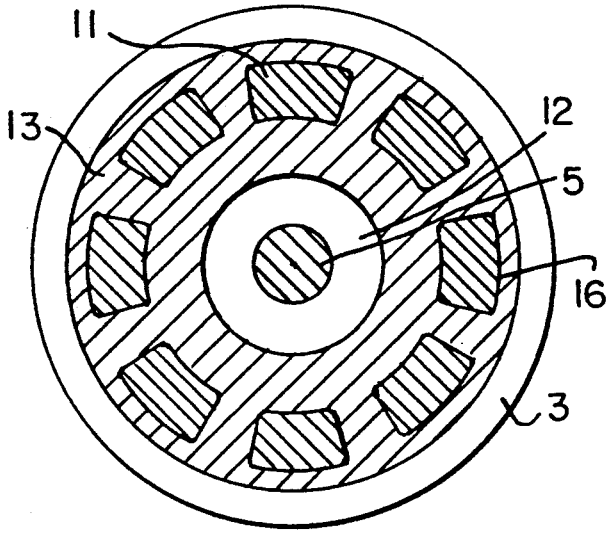
FIG. 4 is a cross sectional view taken substantially along line IV—IV of FIG. 3.

Hub 11 can comprise a hub body 13 and a cover 14 preferably arranged in such a manner that cover 14 forms a seat for knife 3. Cover 14 and hub body 13 preferably form a supporting attachment and are connected detachably to one another, preferably by at least one screw 15. Hub body 13 is made of a non-magnetic or non-magnetizable material such as aluminum, whereas the cover 14 is made of a magnetic or magnetizable material such as steel suitable for electric transformers. Recesses 16 in which permanent magnets 17 are embedded are machined into hub body 13. For example, eight recesses 16 are machined on the periphery of hub body 13 so that up to eight permanent magnets 17 can be inserted into these recesses, as shown in FIG. 4. However, it is possible not to fill each recess with a magnet so that the total force which these magnets exert on knife 3 can be changed.

A disk 18, which covers the recesses 16, can be slid on hub body 13. If disk 18 is also made of a magnetic or magnetizable material such as steel, particularly steel that is suitable for electric transformers, the forces which are exerted by the permanent magnets 17 on upper knife 3 are even more intense. Cover 14 can also be made of steels that are conventional in the construction of electric transformers, but they can also be made of hardened steel. Steels which can be hardened or case hardened may also be utilized so that a seat may be formed with little wear for knife 3. This seat can be made of a shoulder 19 made on cover 14 so that in the finished assembled stage a groove 20 to receive and hold upper knife 3 is produced. This groove is usually wider than upper knife 3 so that upper knife 3 can set itself within specific limits to the actual cutting conditions. The permanent magnets can be simple and preferably are commercially available. The force which the permanent magnets 17 exert on upper knife 3 occurs substantially in the direction of the geometric axis of shaft 5 and thus also hub 11, and is non-mechanical. The magnets act in a non-mechanical manner in the axial direction of the hub 11, the geometric axis of shaft 5, and thus substantially in the direction of the cutting point 8 and its vicinity. The result is inertia-free and friction-free forces, which try to force upper knife 3 continuously in the direction of bottom knife 4. Angle 7 is generally very small, for instance, up to 3°. This angle enables the knives to remain in contact at point 8 while keeping the peripheral cutting edges of the knives separated elsewhere. Even though, when rotating around shaft 5, knife 3 slopes in its mounting due to the alternating approaching of and distancing from the cutting point 8. The proposed magnets generate permanent forces that force knife 3 in the direction of bottom knife 4. In this manner upper knife 3 is exposed to non-mechanical forces, which dampen the vibrations or even prevent upper knife 3 from being set into vibration. Even at very high speeds upper knife 3 can continue to cooperate with the bottom knife 4 at the cutting point 8. This enables the peripheral cutting edges of the two knives to remain in continuous contact during a cutting operation.

The elimination of disk 18 results in a smaller force acting on upper knife 3 so that the magnetic attraction between the two knives is less in total than when the disk is used. Since the available space for the magnets is limited, disk 18 has an increased effect. Instead of permanent magnets 17, electromagnets can also be used. However, this presents an increase in cost, for example, by requiring electric sliding contacts in some cases on the periphery of hub body 13. The result is a finer gradation possibility with respect to those forces that are exerted by the magnets on the upper knife 3. The engineering costs to operate, however, are correspondingly higher. In addition, it is also possible to position upper knife 3, including its supporting hub, in a larger electric field in such a manner that the blades of upper knife 3 and bottom knife 4 are pressed against one another over a larger area than just at the cutting point. However, this option requires a still higher cost, in particular because the hubs and the knives must be replaced when they have become blunt following a long period of service.

The bottom knife may also be mounted on a hub in the same manner as the upper knife is mounted. Preferably, the bottom knife is simply mounted on a shaft for rotation about the axis of the shaft.

The present invention enables a substrate to be machined in such a manner that the machining operation yields a good quality machining. Machining can include, for example, cutting in the longitudinal direction, perforating in the longitudinal direction, or any other machining operation.

Although the present invention has been described in connection with preferred embodiments, it will be appreciated by those skilled in the art that additions, modifications, substitutions and deletions as long as there is a capability of generating non-mechanical forces acting on the knife blades in the cutting point or within the cutting area and not specifically described may be made without departing from the spirit and scope of the invention defined in the appended claims.

We claim:

1. A device for machining sheet like material, particularly a continuous web, said device comprising a first substantially circular knife mounted on a hub body, said hub body being mounted on a first shaft for rotation about an axis of the first shaft, magnetic means located within said hub body, and a second substantially circular knife mounted on a second shaft for rotation about an axis of the second shaft, wherein said first and second knives each have a peripheral cutting edge, said cutting edges being angled with respect to each other and which contact each other at a cutting point to provide a scissor-like cutting action during operation, the two cutting edges being forced into contact with each other by said magnetic means within the hub body of said first knife, said magnetic means magnetically attracting said first knife in a direction toward said second knife thus maintaining the peripheral edges of the first and second knives in continuous contact during operation.

2. A device as defined in claim 1, wherein said first knife is mounted on a supporting attachment which is mounted for rotation about said first shaft axis and said magnetic means is disposed within the supporting attachment.

3. A device as in claim 2, wherein said supporting attachment is a hub for said first knife.

4. A device as defined in claim 3, wherein said hub is made of non-magnetic material.

5. A device as in claim 3, wherein said magnetic means is a plurality of magnets which are positioned within recesses in said hub, and a cover for said recesses is provided to enclose said magnets within said hub, said cover being made of a magnetic material.

6. A device as in claim 1, wherein both said first and said second substantially circular knives are mounted on first and second supporting attachments, respectively, which are mounted for rotation about said first and second shafts axes, respectively.

7. A device as in claim 6, wherein both supporting attachments for said first and second knives include magnets inserted therein, said magnets comprising said magnetic means.

* * * * *